US008403425B2

(12) United States Patent
Kwon et al.

(10) Patent No.: US 8,403,425 B2
(45) Date of Patent: Mar. 26, 2013

(54) PROCESSING METHOD FOR TAPER OF NEEDLE-SHAPED BRISTLE ENHANCED THROUGHPUT

(76) Inventors: Young-Jun Kwon, Gyunggi-do (KR); Sung-Wook Kwon, Seoul (KR); Sung-Hwan Kwon, Seoul (KR)

( * ) Notice: Subject to any disclaimer, the term of this patent is extended or adjusted under 35 U.S.C. 154(b) by 0 days.

(21) Appl. No.: 13/548,893

(22) Filed: Jul. 13, 2012

(65) Prior Publication Data

US 2012/0274124 A1 Nov. 1, 2012

Related U.S. Application Data

(62) Division of application No. 12/526,041, filed as application No. PCT/KR2008/001387 on Mar. 12, 2008, now Pat. No. 8,333,436.

(30) Foreign Application Priority Data

Mar. 13, 2007 (KR) ..... 10-2007-0024440

(51) Int. Cl.
*A46D 1/05* (2006.01)

(52) U.S. Cl. ..... 300/21

(58) Field of Classification Search ..... 300/21
See application file for complete search history.

(56) References Cited

U.S. PATENT DOCUMENTS

2003/0182750 A1* 10/2003 Nishida et al. ..... 15/193

* cited by examiner

*Primary Examiner* — Randall Chin
(74) *Attorney, Agent, or Firm* — Egbert Law Offices, PLLC

(57) ABSTRACT

The present invention relates to a method of tapering a toothbrush bristle which increases production efficiency. The method includes the steps of cutting bundles of toothbrush bristles; and non-directionally immersing the entire cut bundles of toothbrush bristles into a chemical solution to taper both sides of the toothbrush bristles. According to the present invention, the production efficiency of a needle-shaped bristle is increased approximately three-fold, and the loss of raw materials is greatly decreased because several processes are not performed.

3 Claims, No Drawings

PROCESSING METHOD FOR TAPER OF NEEDLE-SHAPED BRISTLE ENHANCED THROUGHPUT

CROSS-REFERENCE TO RELATED U.S. APPLICATIONS

The present invention claims divisional priority from application Ser. No. 12/526,041, filed on Aug. 26, 2009, now U.S. Pat. No. 8,333,436 entitled "Processing Method For Taper Of Needle-shaped Bristle Enhanced Throughput".

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a method of tapering a toothbrush bristle, which increases production efficiency, and, more particularly, to a method of tapering a toothbrush bristle, which increases production by three or more times.

2. Description of Related Art Including Information Disclosed Under 37 CFR 1.97 and 37 CFR 1.98

A method of tapering a polyester toothbrush bristle uses a principle in which, when a polyester fiber is immersed into a heated sodium hydroxide solution, part of the fiber is dissolved. Japanese Examined Utility Model Sho 50-40195 discloses a method of tapering a tip of bristle, in which a bundle of polyester bristles is cut to a predetermined length, is vertically immersed in a sodium hydroxide solution, having a concentration of 20% and a temperature of 100° or more, to a depth of about 5 mm, and is then dissolved (hydrolyzed), based on this principle.

Furthermore, Korean Patent No. 10-0130932 discloses a method of tapering a monofilament for a toothbrush, in which a bundle of toothbrush bristles is dissolved in sulfuric acid, having a concentration of 80~90% and a temperature of 80~200°, and is thus tapered.

Japanese Unexamined Utility Model Sho 57-12934 discloses a technology of manufacturing brushes by implanting bristles, each of which has a taper at one end thereof without folding, or bristles, each of which has tapers at both ends thereof and folded in half, using the above methods. Japanese Examined Utility Model Sho 61-10495 discloses a method of manufacturing a toothbrush by folding a bristle, such that a tapered part of the bristle is relatively long whereas an untapered part of the bristle is relatively short.

Moreover, Japanese Unexamined Utility Model Hei 05-15834 discloses a method of manufacturing a toothbrush by folding toothbrush bristles, each of which has tapers at both ends thereof, in half and implanting them in the head of a toothbrush. This method has been widely used.

Thus, the technology of manufacturing a toothbrush by folding toothbrush bristles has been disclosed, each folded bristle having tapers at both ends thereof, in half and implanting them in the head of a toothbrush. The toothbrush bristles are cut to a predetermined size, one end of the toothbrush bristle is dissolved by vertically immersing the tip of the toothbrush bristle into a chemical, and the other end of the toothbrush bristle is dissolved using the same method. The bristle is then cooled, neutralized, cleaned in water and dried, thereby manufacturing the double end tapered toothbrush bristle.

However, the above method has a problem in that it takes a lot of time to perform a tapering process, and the tapering process is complex. For example, when the tapering process is performed using a sodium hydroxide solution having a concentration of 40% at a temperature of 110°, it takes 80 minutes to perform the process of tapering one end of a toothbrush bristle, and another end of a toothbrush bristle must be tapered after the one end thereof is tapered.

BRIEF SUMMARY OF THE INVENTION

Accordingly, the present invention has been made to solve the above problems, and an object of the present invention is to provide a method of tapering a toothbrush bristle, which can reduce tapering time to ⅓ of a time required for the conventional methods.

Another object of the present invention is to provide a method of tapering a toothbrush bristle, which is simple and can be used to perform a tapering process in a small space.

Technical Solution

As a result of research conducted in order to accomplish the above objects, the present inventors have found that, when a bundle of toothbrush bristles is entirely immersed into a chemical, both ends of the toothbrush bristles are tapered.

Advantageous Effects

As describe in Examples and Comparative Examples, according to the present invention, the production efficiency of a needle-shaped bristle is increased approximately threefold, and the loss of raw materials is greatly decreased because several processes are not performed. Since the immersion process of the present invention is performed only one time, the production efficiency is doubled, compared to the conventional method, in which the immersion process is performed two times. The time required to manufacture a bundle of bristles is decreased, and the immersion time in the present invention, in which the bundle of bristles is entirely immersed, is also decreased, compared to the conventional method, in which only one end of the bundle of bristles is immersed. The reason is that, because the bundle of bristles is entirely immersed into a chemical, a high temperature is maintained, compared to the conventional method, in which only the tip of the bundle of bristles is immersed.

DETAILED DESCRIPTION OF THE INVENTION

Hereinafter, the present invention will be described in detail.

In conventional chemical immersion methods, a bundle of bristles is vertically immersed into a chemical to a depth of about 5 mm, thus allowing the chemical to infiltrate into the bundle of bristles due to a capillary phenomenon.

Here, one end of the bundle of bristles is immersed into the chemical in this manner, and is thus tapered. Thereafter, the other end of the bundle of bristles is vertically immersed into the chemical and tapered, and then the bundle is cooled and washed with water.

Generally, it has been thought to date that, only when a bundle of toothbrush bristles is necessarily vertically immersed into a chemical, the toothbrush bristles are dissolved in the chemical, and the dissolved parts of the toothbrush bristles run down, and thus the tips of the toothbrush bristles are formed in a needle shape. Based on this notion, the toothbrush bristles have been tapered by vertically immersing them into the chemical, which is inefficient.

However, the present inventors discovered the fact that the capillary phenomenon, by which the chemical infiltrates into the bundle of bristles, occurs even when the bundle of bristles is not vertically immersed into the chemical.

As described above, a bundle of toothbrush bristles is formed by collecting and binding individual toothbrush bristles, so that gaps are formed between the bound toothbrush bristles. Since the gaps are formed between the bound toothbrush bristles, a chemical naturally infiltrates into the gaps even when the bundle of toothbrush bristles is not vertically immersed into the chemical, because a capillary phenomenon, similar to that occurring when the bundle of toothbrush bristles is vertically immersed into the chemical, occurs.

Based on this principle, it was found that, when the bundle of toothbrush bristles was entirely and non-directionally immersed into the chemical, the chemical infiltrated into the gaps formed between the bound tooth bristles, as in the case in which the bundle of toothbrush bristles was vertically immersed into the chemical. Thus, both ends of the bundle of toothbrush bristles were simultaneously tapered.

When the bundle of toothbrush bristles is entirely immersed into the chemical, in addition to the advantage in which both ends of the toothbrush bristles can be simultaneously tapered, there is another advantage. That is, when the bundle of toothbrush bristles is partially vertically immersed into the chemical, the toothbrush bristles are tapered relatively slowly because the temperature of the non-immersed portions of the toothbrush bristles is low. In contrast, when the bundle of toothbrush bristles is entirely immersed into the chemical, the reaction rate between the toothbrush bristles and the chemical is increased, and thus the tapering time of the toothbrush bristles is shortened, because the entire bundle of toothbrush bristles contacts the chemical, which has a high temperature.

It takes 2 hours to taper both ends of the bundle of toothbrush bristles using conventional methods, but it takes 30 minutes or less to taper both ends of the bundle of toothbrush bristles using the method of the present invention. The toothbrush bristles obtained using this method have no problem with respect to the quality thereof, except that they have slightly nonuniform tapers and tip thicknesses.

The taper length of toothbrush bristles can be adjusted through a process of preliminarily immersing a bundle of toothbrush bristles into a hydrophilic liquid, such as water, alcohol, ethylene glycol, a surfactant, or the like, before immersing the bundle of toothbrush bristles into the chemical. Here, since the hydrophilic liquid first infiltrates into the gaps formed between the toothbrush bristles through the preliminary immersion process, the infiltrating hydrophilic liquid prevents the chemical from infiltrating into the gaps formed between the toothbrush bristles, thus adjusting the taper length of toothbrush bristles.

Hydrophilic materials that do not rapidly react with the toothbrush bristles or aqueous solutions thereof can be used as the hydrophilic liquid. Hydrophobic materials cannot be used as the hydrophilic liquid because it is difficult to remove them in a water-washing process after chemical treatment. The most preferred hydrophilic liquid may be a chemical at a low concentration (a sodium hydroxide solution or a sulfuric acid solution), which is used to taper the toothbrush bristles. The reason is that such liquids do not chemically react with the chemicals, and can finely dissolve the middle portions of the toothbrush bristles.

Even when a bundle of toothbrush bristles is not preliminarily immersed into a liquid, the effect occurring when the bundle of toothbrush bristles is left in a vapor chamber for a predetermined amount of time (5~60 minutes) is the same as that occurring when the bundle of toothbrush bristles is preliminarily immersed into the liquid. Accordingly, in the present invention, "preliminary immersion" means that the bundle of toothbrush bristles is left in a vapor chamber for a predetermined amount of time, and also means that the bundle of toothbrush bristles is preliminarily immersed into the liquid.

Hydrophilic liquid such as water, etc., used in a preliminary immersion process, decreases the taper length of bristles in proportion to the increase in temperature thereof within the range in which the liquid maintains a liquid phase. The reason is that the chemical more intensively decomposes the bristle at high temperatures, so that liquid at low temperatures decreases the temperature at which the chemical infiltrates into the center of the bundle of bristles, thereby decreasing the decomposition rate of the bristles.

Since the taper length of the bristles is different depending on the kind of liquid used in the preliminary immersion process, the taper length can be adjusted by selecting an appropriate liquid.

When liquid, such as water, having a high surface tension, is used in the preliminary immersion process, a relatively small amount of liquid infiltrates into the gaps between the bundles of bristles, so that the chemical easily infiltrates into the gaps in the bundle of bristles, thereby increasing the taper length of the bristles. In contrast, when liquid, such as alcohol or a surfactant, having a low surface tension, is used in the preliminary immersion process, the taper length of bristles is decreased, for the opposite reason.

In the preliminary immersion process, when the bundle of toothbrush bristles is not entirely immersed into a hydrophilic liquid material, but is partially immersed thereinto such that only one side of the bundle of toothbrush bristles contacts the hydrophilic liquid material, the toothbrush bristles can also be tapered such that the taper lengths at respective ends thereof are different from each other.

In a conventional method, in which a bundle of bristles is vertically immersed into a chemical to a depth of about 5 mm, an apparatus for holding the bundle of bristles is additionally required. Furthermore, a relatively large place is also required because it is impossible for the bundles of bristles to be layered and immersed in the layered state. However, as described in the present invention, when the bundle of bristles is entirely immersed into a chemical, the apparatus for holding the bundle of bristles is not required, and it is possible to perform a process even in a small place because the plurality of bundles of bristles is randomly layered and is entirely immersed into the chemical.

In another embodiment of the present invention, only one end of each bristle is tapered. A needle-shaped bristle, one end of which is tapered, is used in a method of implanting a bristle by fixing the bristle using an anchor, which is a conventional method, and a method of implanting a bristle without using the anchor. Among them, the method of implanting the bristle without using the anchor has been widely used in recent years because various patterns of implanted bristle groups can be formed using this method.

As described above, it is difficult to dissolve the toothbrush bristle because the length of the toothbrush bristle used in the method of implanting a bristle without using the anchor is about ½ of the length of the toothbrush bristle used in the method of implanting a bristle by fixing the bristle using an anchor, which is a conventional method. Thus, the length of the bundle of toothbrush bristles is reduced at the time of vertically tapering the bundle of the toothbrush bristle. It is also difficult to bind the toothbrush bristles using a rubber band after a process of cleaning in water and a drying process because the taper length is relatively long, and it is difficult to produce a toothbrush because the toothbrush bristle does not have desired mechanical properties. Accordingly, in order to overcome the above problems, an inefficient method, in which the toothbrush bristle used in the conventional method of implanting a bristle by fixing the bristle using an anchor is implanted in a toothbrush through a fusion bonding method, and then the portion of the toothbrush bristle other than the portion thereof having a predetermined length is cut and discarded, must be used.

The above problems can be almost overcome using the method of the present invention.

When only one end of bristle is intended to be tapered, two bundles of bristles are layered, the layered portion is sealed using tape so that chemicals do not infiltrate into the layered portion, and then the bundles of toothbrush bristles are entirely immersed into a chemical, as in the conventional method of tapering both ends of bristle.

The conventional chemical treatment is performed two times. However, in a further embodiment of the present invention, the chemical treatment is performed once such that one end of the toothbrush bristle is tapered and the other sharp end thereof is only slightly dissolved. In order to improve a polishing and cleaning property, there is also an embodiment of the prior art, in which one end of the toothbrush bristle is tapered and the other end thereof is not tapered, but an sharp section formed at the time of the cutting process is polished round and then the toothbrush bristle is implanted in a toothbrush with it folded in half. Generally, although the sharp section of the toothbrush bristle is polished round through mechanical polishing methods, the sharp edges of the bristles may be dissolved by performing a chemical immersion process once.

In the present invention, in a method of manufacturing a needle-shaped bristle, one end of which is tapered, by layering two bundles of bristles and sealing them using sealing tape, only a small amount of chemical infiltrates into the bundles of bristles by forming 2~6 small holes having a diameter of 0.5~1.0 mm in the sealing tape, so that the tips of the bristles, which are not to be tapered, are partially dissolved, thereby dissolving the sharp edges of the bristles formed at the time of cutting.

MODE FOR INVENTION

EXAMPLES OF THE PRESENT INVENTION ARE AS FOLLOWS

Example 1

A bundle of polybutylene terephthalate (PBT) 520, having a diameter of 0.2 mm, was cut to a length of 31 mm, and was then entirely immersed into a sodium hydroxide solution, having a concentration of 30% and a temperature of 130, for 35 minutes. Then, the immersed bundle was taken out of the sodium hydroxide solution and cooled by immersing it in cold water. Next, the cooled bundle was neutralized using a weak acid, cleaned in water, and dried, thereby obtaining a toothbrush bristle.

The obtained toothbrush bristle had a tip diameter of 0.01~0.02 mm and a taper length of 7.0~9.0 mm.

It took 25 minutes to taper both sides of the toothbrush bristle.

Example 2

The toothbrush bristle manufacturing process was performed as in Example 1, except that a bundle of PBT 520 was cut, the cut bundle was entirely immersed in water, the immersed bundle was left until water did not flow therefrom, and was then entirely immersed into a sodium hydroxide solution. The obtained toothbrush bristle had a tip diameter of 0.01~0.02 mm and a taper length of 6.0~8.0 mm. The taper length thereof was relatively uniform.

Example 3

The toothbrush bristle manufacturing process was performed as in Example 2, except that the liquid used in the preliminary immersion process was replaced with 20% of ethyl alcohol.

The obtained toothbrush bristle, as in Example 2, had a tip thickness of 0.01~0.02 mm, but had a taper length of 5.0~8.0 mm. The taper length in Example 3 was somewhat decreased compared to the taper length in Example 2.

Example 4

The toothbrush bristle manufacturing process was performed as in Example 2, except that the liquid used in the preliminary immersion process was replaced with a cationic surfactant solution having a concentration of 2%.

The obtained needle-shaped bristle, as in Example 2, had a tip thickness of 0.01~0.02 mm, but had a taper length of 5.0~7.0 mm. The taper length in Example 4 was greatly decreased compared to the taper length in Example 2.

Example 5

The toothbrush bristle manufacturing process was performed as in Example 2, except that the liquid used in the preliminary immersion process was replaced with ethylene glycol.

The obtained toothbrush bristle, as in Example 2, had a tip thickness of 0.01~0.02 mm, but had a taper length of 4.0~6.0 mm.

Example 6

The toothbrush bristle manufacturing process was performed as in Example 2, except that the liquid used in the preliminary immersion process was replaced with a sodium hydroxide (NaOH) solution having a concentration of 5%.

The obtained needle-shaped bristle, as in Example 2, had a tip thickness of 0.01~0.02 mm, but had a taper length of 4.0~5.0 mm.

Example 7

Polybutylene terephthalate (PBT) was mixed with polyester elastomer, and then the mixture thereof was spun using a conventional spinning method, thereby manufacturing bundles of toothbrush bristles having a diameter of 0.18 mm. Next, the manufactured bundles of toothbrush bristles were cut to a length of 20.5 mm, the two cut bundles of toothbrush bristles were attached to each other, and then the attached portion was taped using a heat resistant masking tape having a width of 20 mm to prevent chemicals from infiltrating thereinto. Then, the taped bundle of toothbrush bristles was immersed into a surfactant solution having a concentration of 5% and was then entirely immersed into a sodium hydroxide solution, having a concentration of 30% and a temperature of 130, for 20 minutes. Then, the immersed bundle was taken out of the sodium hydroxide solution and cooled by immersing it in cold water. Next, the cooled bundle was neutralized using a weak acid, cleaned in water, and dried, thereby obtaining a toothbrush bristle.

The obtained toothbrush bristle had a tip diameter of 0.01~0.02 mm and a taper length of 4.0~7.0 mm. The taper length thereof was relatively uniform.

Example 8

The toothbrush bristle manufacturing process was performed as in Example 7, except that four small holes having a diameter of about 0.7 mm were formed around the heat resistant masking tape at regular intervals to allow a small amount of chemical to infiltrate thereinto. As a result, the masking tape-attached portion of the obtained toothbrush bristle, which was not tapered, was slightly dissolved, so that a sharp section formed at the time of the cutting process was removed, thereby preventing damage to the gums.

Comparative Example

The bundle of toothbrush bristles used in Example 1 was vertically immersed into the chemical used in Example 1 for 40 minutes such that the immersed length thereof is 5 mm, and was then separated from the chemical. Next, the separated bundle of toothbrush bristles, as in Example 1, was passed through the cooling, neutralization and cleaning processes. Subsequently, the other portion of the toothbrush bristle was immersed into the chemical, and then passed through the same processes, thereby obtaining both tapered toothbrush bristles.

The tip thickness and taper length of the obtained toothbrush bristles were the same as in Example 1. It took 180 minutes to taper both sides of the toothbrush bristle.

We claim:

1. A method of tapering toothbrush bristles, the method comprising:

cutting bundles of the toothbrush bristles;

aligning two of the cut bundles of the toothbrush bristles in end-to-end relationship;

sealing an end-to-end junction of the aligned bundles with a tape; and immersing the sealed bundles of the toothbrush bristles into a chemical throughout an entire length thereof so as to taper one end of the toothbrush bristles.

2. The method of tapering toothbrush bristles of claim 1, further comprising:

preliminarily immersing the bundles of toothbrush bristles into a hydrophilic liquid material prior to the step of immersing the sealed bundles of toothbrush bristles.

3. The method of tapering toothbrush bristles of claim 1, wherein said tape is formed with two to six holes each having a diameter of between 0.5 millimeter to 1.0 millimeter so as to allow an amount of said chemical to infiltrate a confronting portion so as to taper the end of the toothbrush bristles while dissolving sharp edges of another end of the toothbrush bristles such that the sharp edges become blunt.

* * * * *